United States Patent [19]

Rende et al.

[11] 4,244,780

[45] Jan. 13, 1981

[54] USE OF THIOUREA DIOXIDE IN PULP BLEACHING PROCESSES TO PRESERVE PULP STRENGTH AND AID IN BRIGHTNESS

[75] Inventors: Dominic S. Rende, Woodridge; David R. Cosper, Downers Grove, both of Ill.

[73] Assignee: Nalco Chemical Company, Oak Brook, Ill.

[21] Appl. No.: 94,513

[22] Filed: Nov. 15, 1979

[51] Int. Cl.[3] ..... D21C 9/12

[52] U.S. Cl. ..... 162/72; 162/87

[58] Field of Search ..... 162/71, 72, 87, 88, 162/84

[56] References Cited

U.S. PATENT DOCUMENTS

| | | | |
|---|---|---|---|
| 2,707,145 | 4/1955 | Sparrow et al. | 8/104 |
| 3,177,111 | 4/1965 | Larsen | 162/73 |
| 3,384,534 | 5/1968 | Kindron et al. | 162/71 |
| 3,472,731 | 10/1969 | Liebergott et al. | 162/63 |
| 3,481,828 | 12/1969 | Turner et al. | 162/72 |
| 3,507,743 | 4/1970 | Cartsunis et al. | 162/72 |
| 3,539,445 | 11/1970 | Crossland | 162/76 |
| 3,622,444 | 11/1971 | Andrews | 162/89 |
| 3,808,012 | 3/1967 | Tobar | 162/73 |
| 4,134,787 | 1/1979 | Eckert | 162/72 |
| 4,160,693 | 7/1979 | Lindahl | 162/24 |

OTHER PUBLICATIONS

Pulp & Paper Magazine of Canada, vol. 72, No. 1, Jan. 1971, pp. 80–84.

*Primary Examiner*—William F. Smith

*Attorney, Agent, or Firm*—John G. Premo; Robert A. Miller

[57] ABSTRACT

Inproved pulp strength and brightness of chemically produced pulp can be obtained by treating the pulp with the addition of 0.05–0.5% based on the weight of the dry fiber of thiourea dioxide in the chlorination or hypochlorite bleaching stages.

1 Claim, No Drawings

USE OF THIOUREA DIOXIDE IN PULP BLEACHING PROCESSES TO PRESERVE PULP STRENGTH AND AID IN BRIGHTNESS

INTRODUCTION

This invention relates to a process for the delignification and bleaching of cellulosic pulp produced by a chemical pulping process. Typically, processes of this type are conducted utilizing chemicals which while increasing the brightness of the resulting pulp stock cause fiber degradation and hence, a loss of pulp strength. It has been discovered, however, that through the use of an additive comprising thiourea dioxide increased brightness can be obtained and fiber degradation limited in halogen bleaching processes.

The object of delignification and bleaching of cellulosic pulp is to produce pulp with high brightness, good brightness stability and maximum pulp strength at minimum cost and with minimum environmental pollution. Unfortunately, however, achievement of or improvement in one of the above factors is often attained only at the expense of another of the important factors.

In an effort to achieve a suitable balance between the competing factors, bleach plants have resorted to multistage processes. A typical bleach plant pulp treatment comprises: (a) chlorination (C) of the pulp under acid conditions; (b) alkaline extraction (E) of the chlorinated lignin derivative from the pulp with aqueous sodium hydroxide; (c) oxidation (i.e. bleaching) with sodium hypochlorite (H) under alkaline conditions; (d) a second sodium hydroxide extraction (E); and, (e) a final bleach with chlorine dioxide (D).

Such a sequence is labeled CEHED and is commonly used for delignification and bleaching of kraft (i.e. sulfate) pulp. Similar sequences with fewer stages, such as CEH or CED are commonly used for sulfite pulp which generally contains less lignin and color bodies than does sulfate pulp. Many other such sequences have been proposed and used in the industry's continuing efforts to achieve a suitable balance of the competing factors for the various pulps, pulping processes and end-use physical property requirements.

Regardless of the sequence used, the bulk of cellulose bleaching still is performed using some combination of chlorination (C), alkaline extraction (E) and oxidation (bleaching) stages. The chlorination stage converts most of the colored lignin which remains after the initial pulping or digestion process to chlorinated lignin derivatives which are partially soluble in acidic chlorine solution and particularly soluble in alkaline extraction liquors. Such stage is also referred to as the delignification stage. Although the net effect of such stage (after alkaline extraction) is generally a darkening of the cellulosic pulp attributable to increased color development in the residual lignin material, a major amount of the lignin is removed in the chlorination-extraction sequence, facilitating efficient bleaching reactions in the later oxidation stages.

An extraction stage generally follows chlorination. Such stage serves to remove the chlorinated lignin derivatives from the cellulose substrate, thus exposing for subsequent treatment the lignin material which was unaffected by the chlorination stage by virtue of the topochemical nature of the reaction. H. W. Gierts "Developments in Bleaching Processes," TAPPI, May, 1951, Volume 34 No. 5.

Hypochlorite treatments conducted under alkaline conditions, and chlorine dioxide treatments conducted at acidic pH value are primarily characterized by destructive oxidation of residual colored lignin to colorless degradation products. Such stage is therefore, primarily a bleaching stage through some minor amount of chlorination followed by extraction of the alkaline or acidic bleaching liquors may occur simultaneously.

Of the competition between important factors, the tradeoff between brightness and pulp strength (often measured as pulp viscosity) has been of particular concern to the paper industry and has been primarily responsible for the proliferation of the various bleaching sequences. Such tradeoff apparently results from a nonselective oxidation reaction. By the term "nonselective," it is meant that the oxidation action is not limited to lignin oxidation, but instead also involves destructive oxidation of the cellulosic material, thus reducing the length of the cellulosic molecules and accordingly, reducing the strength and viscosity of the pulp. The exact extent of such cellulose oxidation depends upon reaction conditions such as temperature, pH, reaction time and chlorine concentration, and upon the nature of the pulp being treated. For example, the brightness-strength tradeoff is delignification and bleaching is less pronounced for sulfite pulp than it is for sulfate pulp since less severe treatment is required for sulfite pulp than for sulfate pulp to achieve equivalent brightness characteristics.

In either case, that is for sulfite or sulfate produced pulps, fiber degradation occurs during the delignification and bleaching steps. While physical parameters such as the concentration of bleaching agent, temperature and time can be optimized for a given system, invariably pulp degradation occurs. As such, it would be a benefit to the art if a method could be obtained for maintaining pulp strength of chemically produced cellulosic pulp during the delignification and bleaching stages.

It is therefore an object of this invention to provide to the art a process for increasing brightness and limiting fiber degradation during chemical delignification and bleaching processes.

A further object of this invention is to provide to the art an improved process for the delignification and bleaching of chemically produced cellulosic pulp which encompasses maintaining in the aqueous slurry of the pulp during the initial chlorination stage from 0.01–0.5 weight percent based upon the dry weight of the fiber of thiourea dioxide.

THE INVENTION

The present invention is applicable to all liquid phase acidic chlorination processes for the delignification of wood pulp produced by chemical pulping processes. While chlorination is the general method employed industrially for the delignification of pulps of this type, bromine or other halogens can also be employed (see for example U.S. Pat. No. 4,096,029 which is hereby incorporated by reference). It will be readily seen that this invention also applies to those processes.

The additive of this invention, thiourea dioxide is water-soluble. The exact reason or mechanism in which the thiourea dioxide of this invention functions is not known to us but results have indicated its performance in this application. The present invention is applicable to most commercial bleaching stages which use multistages, including chlorination, extraction and generally treatment with an oxidizing agent such as chlorine dioxide. We have discovered that the chemical treatment of this invention need only be present in the initial chlorination stage and is generally added to the pulp slurry as a presoak additive immediately prior to the chlorination step. It is not known if the chemical treatment is carried forward to the other stages or where the chemical treatment of the instant invention winds up.

In the practice of this invention, the thiourea dioxide is generally added to the pulp at a dosage of from 0.01–0.50% based upon the weight of oven dried pulp. Preferably, from 0.1–0.25% of additive based on oven dried pulp is used.

While thiourea dioxide may be used alone as a bleaching additive in the course of this invention, it may be combined with other additives to produce equally dramatic results. As an example, thiourea dioxide can be combined with low molecular weight polyacrylic acid dispersants. The polymer in this case appears to enhance the effect of the additive of this invention. Of course, other additives which are generally used in the pulp bleaching process can be employed along with the materials of this invention.

In order to illustrate our invention, the following examples are presented:

EXPERIMENTAL PROCEDURE

Procedure for pulp bleaching

A. Chemical Preparation:

1. Chlorine water was prepared by dispersing chlorine gas through deionized water until saturated.
2. Caustic solutions were prepared by dissolving 25 grams of sodium hydroxide in deionized water to form 1 liter of solution.
3. Hypochlorite was obtained commercially under the trademark CHLOROX and then diluted with deionized water to approximately 10 grams (as $Cl_2$) per liter.
4. Chlorine dioxide was generated through the sodium chlorite-aqueous chlorine ($Cl_2$) pathway.

B. The thiourea dioxide material used during pulp bleaching is diluted to a 5% product solution with deionized water prior to use. The procedure that follows is a step-by-step explanation of the bleaching process employed.

50 grams of fiber based on o.d. equivalents are placed in heat sealable polyethylene bags. Enough deionized water is then added to meet stage consistencies minus the water necessary to dissolve the bleaching chemical employed. Additives to be tested within a particular stage are added to the dilution waters of that stage. Each bag is then placed in a constant temperature bath for 30 minutes. This offers a consistent bleaching temperature and sufficient chemical to fiber contact.

Bleaching chemicals are then added to each bag and the bags are quickly heat sealed, identified and thoroughly mixed. Mixing is performed by hand massaging and continues for 2 minutes. Subsequent mixing of stage temperature stock is accomplished every 10–15 minutes. Upon stage completion, the bags are opened and enough filtrate is drawn off to conduct appropriate tests. Fiber and remaining liquors are washed out with stage temperature in deionized water to a 4:1 water to liquor ratio on a vacuum drawn Buchner funnel employing filtered paper.

The pulp mat is then separated from the filter pad and is weighed to determine moisture content for subsequent steps. Upon completion of all bleaching stages, the pulp mat is homogenized to insure evenly distributed moisture and samples are drawn for testing and to prepare 2 gram hand sheets according to TAPPI T-205. Permanganate numbers of pulps (useful to determine lignin content) were accomplished utilizing TAPPI procedure T-214. Kappa No. of pulps were determined using TAPPI T-236. Viscosity of pulp (useful to determine the amount of cellulose degradation during bleaching) was determined utilizing a capillary viscometer method as outlined in TAPPI T-230. For details of TAPPI Procedures T-230 and T-214, see U.S. Pat. No. 4,096,029.

Brightness of hand sheets produced was measured using a General Electric reflectance meter. This instrument and its operation is well-known in the paper industry and results reported are indicated by "GE brightness." The results indicate the percentage of light reflected by a given sample.

EXAMPLE 1

The effect of thiourea dioxide as a "C" stage viscosity preparation additive was investigated. The pulp mass employed was a softwood kraft fiber having a GE brightness of 24.2%, a 0.5 M C.E.D. viscosity of 22.30 and a permanganate number of 17.0. The bleaching sequence employed was C.E.D. The pulp was maintained during chlorination at 3% consistency for 60 minutes at various chlorine and pH levels. The extraction stage was conducted at 10% consistency for 60 minutes at 160° F. In the dioxide stage, 1.25% $ClO_2$ was employed, the pulp was again held at 10% consistency at 160° F. for 180 minutes. Capillary viscosities were run on post C.E.D. bleached fiber. Thiourea dioxide, in the runs in which it was utilized, was added at a level of 0.075 grams per 50 grams of fiber sample. Results of the effect of thiourea dioxide treatment are found in Table I.

TABLE I

VISCOSITY PRESERVATION DURING CHLORINATION
USE OF THIOUREA DIOXIDE AS A SOFTWOOD KRAFT VISCOSITY PRESERVATION AID

| | | CHLORINATION PARAMETERS | | | TESTING RESULTS | | |
|---|---|---|---|---|---|---|---|
| TREATMENT | DOSAGE IN LBS/ TON O.D. BASIS | % APPLIED $Cl_2$[1] | % NaOH BUFFER | TEMP. °C. | VISCOSITY[2] | % VISCOSITY PRESERVATION | FINAL pH POST C |
| Unbleached Ref. | | | | | 22.30 | 100 | |
| I. None | 0 | 3.40 | 0 | 25 | 16.27 | — | 1.95 |
| Thiourea Dioxide | 3.0 | 3.40 | 0 | 25 | 20.20 | 65 | 1.95 |
| None | 0 | 3.40 | 1.575 | 25 | 14.36 | — | 2.70 |
| Thiourea Dioxide | 3.0 | 3.40 | 1.575 | 25 | 19.13 | 60 | 2.75 |
| None | 0 | 3.40 | 0 | 40 | 15.61 | — | 1.95 |
| Thiourea Dioxide | 3.0 | 3.40 | 0 | 40 | 19.26 | 55 | 1.90 |
| II. None | 0 | 3.91 | 0 | 25 | 15.70 | — | 2.05 |
| Thiourea Dioxide | 3.0 | 3.91 | 0 | 25 | 19.51 | 58 | 1.95 |
| None | 0 | 3.91 | 2.055 | 25 | 16.59 | — | 2.70 |

TABLE I-continued

VISCOSITY PRESERVATION DURING CHLORINATION
USE OF THIOUREA DIOXIDE AS A SOFTWOOD KRAFT VISCOSITY PRESERVATION AID

| TREATMENT | DOSAGE IN LBS/ TON O.D. BASIS | CHLORINATION PARAMETERS % APPLIED $Cl_2$[1] | % NaOH BUFFER | TEMP. °C. | TESTING RESULTS VISCOSITY[2] | % VISCOSITY PRESERVATION | FINAL pH POST C |
|---|---|---|---|---|---|---|---|
| Thiourea Dioxide | 3.0 | 3.91 | 2.055 | 25 | 19.20 | 46 | 2.80 |
| None | 0 | 3.91 | 0 | 40 | 15.80 | — | 2.00 |
| Thiourea Dioxide | 3.0 | 3.91 | 0 | 40 | 19.16 | 52 | 2.05 |
| III. None | 0 | 4.42 | 0 | 25 | 14.30 | — | 1.90 |
| Thiourea Dioxide | 3.0 | 4.42 | 0 | 25 | 18.93 | 58 | 1.90 |
| None | 0 | 4.42 | 0 | 40 | 13.31 | — | 1.90 |
| Thiourea Dioxide | 3.0 | 4.42 | 0 | 40 | 18.30 | 56 | 1.90 |

[1]Percent based on oven dried fiber mass.
[2]Tappi Standard T-230: Capillary viscometer method/0.5M C.E.D.

EXAMPLE 2

The use of thiourea dioxide as a hardwood kraft viscosity preparation aid was evaluated. The pulp source was northern hardwood, maple-elm mixture. This material had a GE brightness of 28.0, a viscosity of 16.05, $K_p$ lignin content 11.65, $K_k$ lignin content 14.95. The bleaching sequence employed was CED. The pulp was maintained during the "C" stage at a 3% consistency for 60 minutes. During the "E" stage a 10% consistency for 60 minutes at 160° F. was employed. In the "D" stage, 1.2% $ClO_2$ was employed, and the pulp was again held at a 10% consistency for 180 minutes at 160° F. Bleaching was accomplished in plastic bags set in constant temperature water baths. Results of this experiment are shown in Table II. From the results in Table II, it is evident that thiourea dioxide acts as a cellulose preservation aid at both high temperature and high chlorine content levels in the "C" stage. This is true even when low levels of thiourea dioxide are employed. Pulp viscosities above the original level were observed at all occurrences. Brightnesses were not substantially effected by the addition of thiourea dioxide.

EXAMPLE 3

The use of thiourea dioxide as a preservative aid during the chlorination of a kraft cooked softwood was investigated. This fiber source was a 50/50 mixture of red wood and Douglas fir. The bleaching stage utilized varying amounts of chlorine at a 3.0% pulp consistency for 60 minutes. The "E" stage employed various levels of sodium hydroxide equivalent to ½ the applied chlorine percent at a 10% pulp consistency for 60 minutes at 160° F. The "D" stage employed 2.0% $ClO_2$ at a 10% pulp consistency for 120 minutes at 160° F. Results are shown in Table III.

The mixture of the softwood, red wood/Douglas fir mixture exhibited unusual bleaching response. Very low chlorine residuals were seen at 150% $Cl_2$ at 25° C. and none were observed in low oxidizing environments. The initial pulp degradation of 2–3.5 cps was lower than expected and reinforced by the preservation potential of the thiourea dioxide at the chlorine levels utilized. The protective ability of the thiourea dioxide can be seen in all of the examples in providing an excess of 80% or the original pulp viscosity. While there is a slight tendency to diminish pulp brightness, the results suggest that this effect might not be apparent at standard mill operating parameters.

TABLE II

VISCOSITY PRESERVATION DURING CHLORINATION
USE OF THIOUREA DIOXIDE AS A HARDWOOD VISCOSITY PRESERVATION AID

| TREATMENT | DOSAGE IN LBS/ TON O.D. BASIS | CHLORINATION PARAMETERS % APPLIED CHLORINE | TEMP. °C. | TEST RESULTS 0.5M C.E.D. VISCOSITY[1] | % VISCOSITY PRESERVATION[2] | % G.E. BRITE POST C.E.D. |
|---|---|---|---|---|---|---|
| Unbleached Ref. | | | | 16.05 | 100 | 28.0 |
| I. None | 0 | 2.56 | 25 | 14.03 | — | 70.0 |
| Thiourea Dioxide | 1.5 | 2.56 | 25 | 16.70 | 132 | 69.0 |
| Thiourea Dioxide | 3.0 | 2.56 | 25 | 16.75 | 135 | 60.2 |
| II. None | 0 | 3.03 | 25 | 11.21 | — | 72.7 |
| Thiourea Dioxide | 1.5 | 3.03 | 25 | 16.05 | 100 | 72.0 |
| Thiourea Dioxide | 3.0 | 3.03 | 25 | 16.15 | 102 | 71.9 |
| III. None | 0 | 3.50 | 25 | 10.08 | — | 74.2 |
| Thiourea Dioxide | 1.5 | 3.50 | 25 | 14.72 | 78 | 74.4 |
| Thiourea Dioxide | 3.0 | 3.50 | 25 | 14.95 | 82 | 74.1 |
| IV. None | 0 | 2.56 | 50 | 13.88 | — | 73.1 |
| Thiourea Dioxide | 1.5 | 2.56 | 50 | 16.07 | 100 | 73.0 |
| Thiourea Dioxide | 3.0 | 2.56 | 50 | 16.12 | 101 | 72.4 |
| V. None | 0 | 3.03 | 50 | 10.00 | — | 74.8 |
| Thiourea Dioxide | 1.5 | 3.03 | 50 | 15.72 | 95 | 74.1 |
| Thiourea Dioxide | 3.0 | 3.03 | 50 | 15.65 | 93 | 73.8 |
| VI. None | 0 | 3.50 | 50 | 9.01 | — | 75.9 |
| Thiourea Dioxide | 1.5 | 3.50 | 50 | 14.65 | 80 | 74.9 |
| Thiourea Dioxide | 3.0 | 3.50 | 50 | 14.90 | 84 | 75.2 |

[1]Tappi Standard T-230. Capillary viscometer method.
[2]Unbleached reference 100% viscosity preservation after dioxide stage of a C.E.D. sequence.

TABLE III

VISCOSITY PRESERVATION DURING CHLORINATION
USE OF THIOUREA DIOXIDE AS A WESTERN SOFTWOOD[1] VISCOSITY PRESERVATION AID

| TREATMENT | DOSAGE IN LBS/ TON O.D. FIBER | CHLORINATION PARAMETERS % APPLIED CHLORINE[2] | TEMP. °C. | TESTING RESULTS VISCOSITY cps[3] | % VISCOSITY PRESERVATION[4] | % G.E. BRIGHTNESS POST C.E.D. |
|---|---|---|---|---|---|---|
| Unbleached Ref. | | | | 34.97 | 100 | 19.2 |
| I. None | 0 | 4.71 | 25 | 32.81 | — | 44.4 |
| Thiourea Dioxide | 3.0 | 4.71 | 25 | 35.94 | 145 | 44.4 |
| None | 0 | 4.71 | 40 | 31.52 | — | 48.0 |
| Thiourea Dioxide | 3.0 | 4.71 | 40 | 35.92 | 143 | 45.7 |
| II. None | 0 | 5.56 | 25 | 28.50 | — | 53.4 |
| Thiourea Dioxide | 3.0 | 5.56 | 25 | 33.52 | 78 | 51.8 |
| None | 0 | 5.56 | 40 | 26.50 | — | 55.4 |
| Thiourea Dioxide | 3.0 | 5.56 | 40 | 34.18 | 91 | 52.8 |
| III. None | 0 | 6.42 | 25 | 24.17 | — | 59.1 |
| Thiourea Dioxide | 3.0 | 6.42 | 25 | 33.08 | 83 | 56.2 |
| None | 0 | 6.42 | 40 | 20.59 | — | 60.4 |
| Thiourea Dioxide | 3.0 | 6.42 | 40 | 33.83 | 92 | 59.1 |

[1]50/50 mixture of Red Wood/Douglas Fir Kamyr kraft fiber.
[2]Based on unbleached K (permanganate no.) K = 21.4.
[3]Tappi Standard T-230: 0.5M C.E.D. Capillary viscometer method.
[4]Unbleached reference equal to 100% preservation if measured after the dioxide stage of a C.E.D. sequence.

Having thus described the invention, we claim:

1. In a method for the bleaching of aqueous slurries of chemically produced cellulosic materials utilizing chlorine as a bleaching agent, the improvement comprising maintaining in the aqueous slurry of chemically produced cellulosic materials during treatment with said bleaching agent from 0.05–0.5% by weight of thiourea dioxide based on the dry weight of cellulosic material in said aqueous slurry whereby a cellulosic material having improved fiber strength is obtained.

* * * * *